US011139572B2

(12) United States Patent
Zhang et al.

(10) Patent No.: US 11,139,572 B2
(45) Date of Patent: Oct. 5, 2021

(54) FEED APPARATUS, DUAL-BAND MICROWAVE ANTENNA, AND DUAL-BAND ANTENNA DEVICE

(71) Applicant: HUAWEI TECHNOLOGIES CO., LTD., Guangdong (CN)

(72) Inventors: Luqi Zhang, Chengdu (CN); Rui Lyu, Chengdu (CN); Xin Luo, Chengdu (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 16/735,313

(22) Filed: Jan. 6, 2020

(65) Prior Publication Data

US 2020/0144720 A1 May 7, 2020

Related U.S. Application Data

(63) Continuation of application No. PCT/CN2018/097286, filed on Jul. 26, 2018.

(51) Int. Cl.
*H01Q 5/307* (2015.01)
*H01Q 13/02* (2006.01)
(Continued)

(52) U.S. Cl.
CPC ..... *H01Q 5/307* (2015.01); *H01Q 13/02* (2013.01); *H01Q 21/0006* (2013.01); *H01Q 21/064* (2013.01)

(58) Field of Classification Search
CPC .. H01Q 1/50; H01Q 1/36; H01Q 5/00; H01Q 5/42; H01Q 5/307; H01Q 13/02; H01Q 13/0225
See application file for complete search history.

(56) References Cited

U.S. PATENT DOCUMENTS 2,972,148 A * 2/1961 Rupp ..... H01Q 25/001 343/776
4,130,823 A * 12/1978 Hoople ..... H01Q 13/18 343/768
(Continued)

FOREIGN PATENT DOCUMENTS

CN 102394374 A 3/2012
CN 102394375 A 3/2012
(Continued)

OTHER PUBLICATIONS

Office Action issued in Chinese Application No. 201880046580.4 dated Aug. 6, 2020, 17 pages (with English translation).
(Continued)

*Primary Examiner* — Lam T Mai
(74) *Attorney, Agent, or Firm* — Fish & Richardson P.C.

(57) ABSTRACT

This application provides a feed apparatus, a dual-band microwave antenna, and a dual-band antenna device. The feed apparatus includes a low-frequency feed and a high-frequency feed. The high-frequency feed is embedded into the low-frequency feed. The low-frequency feed includes a plurality of low-frequency array elements arranged in an array. The high-frequency feed includes a plurality of high-frequency array elements arranged in an array. At least one high-frequency array element is embedded into the low-frequency array element, and the low-frequency array element and each high-frequency array element embedded into the low-frequency array element have a common waveguide wall.

15 Claims, 17 Drawing Sheets

(51) Int. Cl.
*H01Q 21/00* (2006.01)
*H01Q 21/06* (2006.01)

(56) References Cited

U.S. PATENT DOCUMENTS 4,489,331 A * 12/1984 Salvat ..... H01Q 5/45 343/753
4,783,663 A 11/1988 Rammos et al.
4,998,113 A * 3/1991 Raghavan ..... H01Q 13/02 333/135
5,485,167 A * 1/1996 Wong ..... H01Q 21/062 343/753
5,926,146 A * 7/1999 Seck ..... H01Q 19/17 343/725
6,650,291 B1 * 11/2003 West ..... H01Q 3/46 342/371
7,639,197 B1 * 12/2009 Herting ..... H01P 1/181 333/157
8,350,773 B1 * 1/2013 Kindt ..... H01Q 13/085 343/770
9,729,423 B1 * 8/2017 Tinoco ..... H04W 88/02
9,923,284 B1 * 3/2018 Loui ..... H01Q 15/0086
2002/0075190 A1 * 6/2002 Ghosh ..... H01Q 9/0442 343/702
2010/0045559 A1 * 2/2010 Rossetto ..... H01Q 5/357 343/792
2011/0074646 A1 * 3/2011 Snow ..... H01Q 19/28 343/833
2016/0045260 A1 * 2/2016 Rossetto ..... A61B 18/1815 606/33
2016/0204509 A1 7/2016 Zhai et al.
2017/0141465 A1 * 5/2017 Sharawi ..... H01Q 21/28
2017/0170563 A1 * 6/2017 Maas ..... H01Q 21/061
2019/0020112 A1 * 1/2019 Luo ..... H01Q 5/47
2019/0051990 A1 * 2/2019 Luo ..... H01Q 19/191
2020/0212573 A1 * 7/2020 Syed ..... H01Q 5/47

FOREIGN PATENT DOCUMENTS

CN 102610901 A 7/2012
CN 104051860 A 9/2014
CN 105161862 A 12/2015
CN 106410413 A 2/2017
CN 106785469 A 5/2017
CN 107069225 A 8/2017
CN 107546475 A 1/2018
CN 107658568 A 2/2018
CN 107910650 A 4/2018
DE 3626856 A1 2/1988
JP 2007235563 A 9/2007
JP 2016181747 A 10/2016

OTHER PUBLICATIONS

PCT International Search Report and Written Opinion in International Application No. PCT/CN2018/097,286, dated Apr. 8, 2019, 11 pages (With Partial English Translation).
Extended European Search Report issued in European Application No. 18925714.0 dated Jul. 13, 2020, 9 pages.
Office Action issued in Chinese Application No. 201880046580.4 dated Feb. 4, 2021, 6 pages (with English translation).

* cited by examiner

FEED APPARATUS, DUAL-BAND MICROWAVE ANTENNA, AND DUAL-BAND ANTENNA DEVICE

CROSS-REFERENCE TO RELATED APPLICATIONS

This application is a continuation of International Application No. PCT/CN2018/097286, filed on Jul. 26, 2018, the disclosure of which is hereby incorporated by reference in its entirety.

TECHNICAL FIELD

This application relates to the field of antenna technologies, and in particular, to a feed apparatus, a dual-band microwave antenna, and a dual-band antenna device.

BACKGROUND

As a technical means for effectively improving a transmission capacity of a microwave network, a dual-band microwave antenna transmits a high-frequency signal and a low-frequency signal on a same link, to combine a large capacity in a high frequency band with a long distance in a low frequency band, and enhance a QoS service protection mechanism while providing a large capacity. In addition, as requirements of 5G services for a large capacity and an IP-based service and demands for a capacity of a microwave backhaul network increase sharply, a high-frequency signal may be in an E-band (71-76 GHz or 81-86 GHz) with a high channel bandwidth. However, features of the E-band are affected by factors such as a high spatial loss, severe rain attenuation, and a poor anti-shake capability caused by a small half-power angle. Consequently, a transmission distance and stability in the E-band are limited, further limiting operating performance of the dual-band microwave antenna.

A feed apparatus is a core component of a dual-band microwave antenna, and a structure form of the feed apparatus determines operating performance of the dual-band microwave antenna to a great extent. Currently, the dual-band microwave antenna implements dual-band operation by using a dual-band coaxial feed, an outer conductor is a coaxial horn operating in a low frequency band, and an inner conductor is a dielectric rod operating in a high frequency band. Although the dual-band coaxial feed can be integrated, a dielectric loss of the high-band dielectric rod feed is relatively high and directly affects an antenna gain. In addition, a beam width of the dual-band microwave antenna in a high frequency band is small and beam scanning cannot be implemented, resulting in a poor anti-shake capability. Consequently, availability of a large-capacity and high-band dual-band microwave antenna is very low.

SUMMARY

This application provides a feed apparatus, a dual-band microwave antenna, and a dual-band antenna device, to integrate a plurality of high-frequency array elements, thereby improving an anti-shake capability of the dual-band microwave antenna.

According to a first aspect, this application provides a feed apparatus. The feed apparatus includes a low-frequency feed and a high-frequency feed. The high-frequency feed is embedded into the low-frequency feed. The low-frequency feed includes a plurality of low-frequency array elements arranged in an array. The high-frequency feed includes a plurality of high-frequency array elements arranged in an array. At least one high-frequency array element is embedded into the low-frequency array element, and the low-frequency array element and each high-frequency array element embedded into the low-frequency array element have a common waveguide wall. In the feed apparatus, the high-frequency feed is embedded into the low-frequency feed, to be specific, the array of the high-frequency array elements is embedded into the array of the low-frequency array elements, and the at least one high-frequency array element is embedded into the low-frequency array element. In addition, the low-frequency array element and each high-frequency array element embedded into the low-frequency array element have the common waveguide wall. In this way, the high-frequency feed can be effectively integrated with the low-frequency feed, so that a structure of the feed apparatus is compact, and the high-frequency feed and the low-frequency feed are of good equalization. In addition, because the plurality of high-frequency array elements are integrated into the feed apparatus, beam scanning of an antenna in a high frequency band can be implemented by switching of the plurality of high-frequency array elements, so that a beam width of a high-gain beam in the high frequency band can be increased to resist shaking. Therefore, a particular anti-shake capability is achieved in the high frequency band, and availability of a large-capacity high-frequency link can be improved while a standby function of a low-frequency link is reserved.

In a specific implementation solution, to ensure a feeding function of a feeding apparatus, specifically, the low-frequency array element and each high-frequency array element embedded into the low-frequency array element are two array elements that perform feeding independently. In this way, although disposed in an embedded manner, the low-frequency array element and the high-frequency array element perform feeding independently, so that it is ensured that the low-frequency array element and the high-frequency array element can perform normal feeding after the high-frequency array element is embedded into the low-frequency array element.

In a specific implementation solution, the low-frequency array element includes a low-frequency feeding port used for feeding, the high-frequency array element includes a high-frequency feeding port used for feeding, and the low-frequency feeding port of the low-frequency array element is galvanically isolated from the high-frequency feeding port of each high-frequency array element embedded into the low-frequency array element, so that it is ensured that the low-frequency array element and the high-frequency array element embedded into the low-frequency array element can perform feeding independently.

In a specific implementation solution, to ensure galvanic isolation between the high-frequency feeding port and the low-frequency feeding port, the low-frequency array element has a square aperture, the low-frequency feeding port has a rectangular aperture, the high-frequency array element has a square aperture, and the high-frequency feeding port has a rectangular aperture. The feeding apertures should meet the following relationship: a length of a narrow aperture side of the low-frequency feeding port is less than a difference between an aperture length of the low-frequency array element and twice an aperture length of the high-frequency array element, so that the high-frequency array element is not embedded into the low-frequency feeding port of the low-frequency array element during embedding, to ensure that the high-frequency feeding port and the low-frequency feeding port are isolated from each other.

In a specific implementation solution, the low-frequency array element is a first metal horn, the high-frequency array element is a second metal horn, and an aperture of the first metal horn is larger than an aperture of the second metal horn. An aperture relationship between the two metal horns is limited, so that it is ensured that one of the two metal horns is a high-frequency array element and the other is a low-frequency array element.

In a specific implementation solution, to embed the high-frequency array element into the low-frequency array element, the second metal horn has a first side wall and a second side wall, the first side wall is adjacent and connected to the second side wall, the first metal horn includes a horn mouth, the second metal horn is embedded into the first metal horn, and the first side wall and the second side wall are located in the horn mouth. The first metal horn and the second metal horn are connected as a whole by using the first side wall and the second side wall, so that the high-frequency feed and the low-frequency feed are effectively integrated, and the structure of the feed apparatus is compact.

In a specific implementation solution, to implement feeding by the feed apparatus, the low-frequency feed includes at least four first metal horns, and two adjacent first metal horns are fixedly connected. A plurality of first horns and second horns are integrated through a fixed connection between the first horns and embedding between the first horn and the second horn, to ensure structural stability.

In a specific implementation solution, end surfaces of horn mouths of two adjacent first metal horns are fixed as a whole, and a plurality of second metal horns are embedded into the first metal horn. In this way, it is ensured that the plurality of second horns are embedded into the first metal horns when there is no interval between the first metal horns.

In a specific implementation solution, when there is an interval between the first metal horns, a second metal horn is disposed within the interval, and two first metal horns are fixedly connected by using at least one second metal horn.

In a specific implementation solution, specifically, each first metal horn has only one second metal horn, or at least two second metal horns are embedded into the first metal horn, and at least two second metal horns embedded into the first metal horn are arranged in a row along an extension direction of a wide aperture side of the low-frequency feeding port of the low-frequency array element.

In a specific implementation solution, an interval length between adjacent low-frequency array elements is less than an operating wavelength of the low-frequency array element, and a grating lobe is suppressed by limiting an interval distance between the low-frequency array elements.

In a specific implementation solution, an interval length between adjacent high-frequency array elements is less than $1/(1+\sin\theta)$ times an operating wavelength of the high-frequency array element, where $\theta$ is a maximum scanning angle of the high-frequency feed, and a grating lobe is suppressed by limiting an interval distance between the high-frequency array elements.

According to a second aspect, this application provides a dual-band microwave antenna, including the feed apparatus according to any one of the foregoing technical solutions, and further including a feeding tributary. Radio frequency switches respectively corresponding to high-frequency array elements are disposed on the feeding tributary, and the radio frequency switch is configured to control switching of the high-frequency array element. In the foregoing dual-band microwave antenna, switching of the high-frequency array element is controlled by an action of the radio frequency switch, to implement beam scanning of the dual-band microwave antenna in a high frequency band, thereby improving availability of a large-capacity high-frequency link in a dual-band antenna transmission system, and reserving a standby function of a low-frequency link.

In a specific implementation solution, specifically, the dual-band microwave antenna may be a Cassegrain antenna, and a phase center of a feed formed by four array elements in a central area of the high-frequency feed coincides with a focus of the Cassegrain antenna. The dual-band microwave antenna may alternatively be a reflector antenna such as a ring-focus antenna.

According to a third aspect, this application provides a dual-band antenna device, including an indoor microwave unit and an outdoor microwave unit that is in signal connection with the indoor microwave unit, and including the dual-band microwave antenna according to any one of the foregoing technical solutions. The dual-band microwave antenna is connected to the outdoor microwave unit by using a feeding waveguide. In the foregoing dual-band antenna device, the dual-band microwave antenna performs transmission in a same dual-band microwave antenna in both a low frequency band and a high frequency band, so that a beam width of the antenna in the high frequency band can be effectively increased while a large bandwidth is used and a transmission distance is increased. In this way, the dual-band microwave antenna achieves an anti-shake capability in the high frequency band, and availability of a high-band link is improved.

DESCRIPTION OF EMBODIMENTS

To make the objectives, technical solutions, and advantages of the present invention clearer, the following further describes the present invention in detail with reference to the accompanying drawings.

For continuous improvement of a transmission capacity of a microwave network in the prior art, a dual-band microwave antenna in the prior art implements dual-band operation by using a dual-band coaxial feed but a beam width in a high frequency band is small, resulting in a poor anti-shake capability. To improve the anti-shake capability, embodiments of this application provide a feed apparatus. In the feed apparatus, structures and fixing manners of a high-frequency feed and a low-frequency feed are changed, so that the anti-shake capability is improved. A plurality of high-frequency array elements are embedded into a plurality of low-frequency array elements, and they are integrated by using a common waveguide wall. Beam scanning of an antenna in a high frequency band can be implemented by switching of a plurality of high-frequency array elements, so that a beam width of a high-gain beam in the high frequency band can be increased to resist shaking. In the embodiments of this application, a high-frequency array element refers to an independent unit in a high-frequency feed, and a low-frequency array element refers to an independent unit in a low-frequency feed. Array arrangement may include a linear array, for example, a square array, or may include a circular array. A form of a waveguide wall mentioned in the embodiments of this application is a metal waveguide wall or a frequency selective surface that performs total transmission for a low-band electromagnetic wave and total reflection for a high-band electromagnetic wave.

For ease of description, the embodiments of this application provide a description by using a feed apparatus with four low-frequency array elements that form a 2×2 square array. A feed apparatus having more than four low-frequency array elements is similar to the feed apparatus. In addition, the embodiments of this application provide a description by using a feeding apparatus with a high-frequency array element and a low-frequency array element that each have only a square aperture. A feeding apparatus with another aperture is similar to the feeding apparatus.

Figure 2:
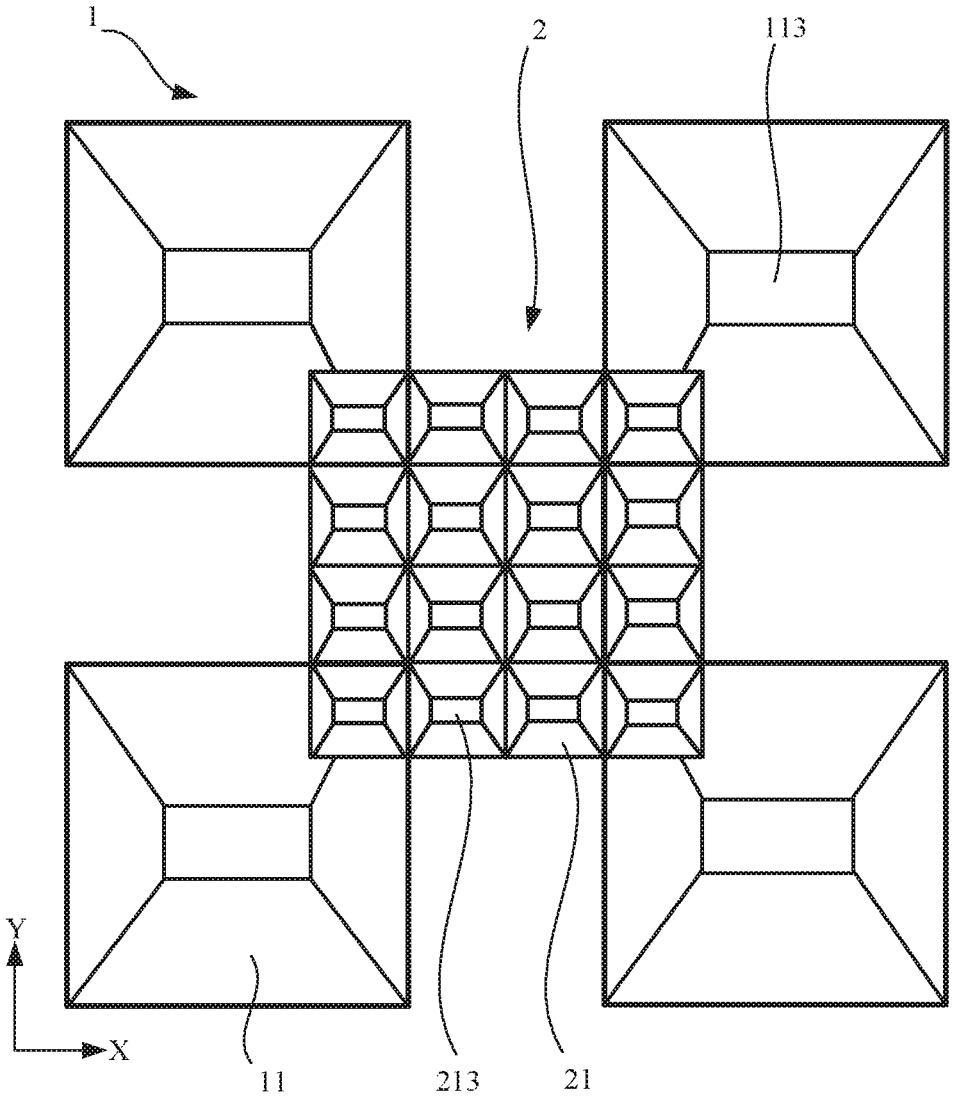
FIG. 2 is a main view of FIG. 1.
Figure 4:
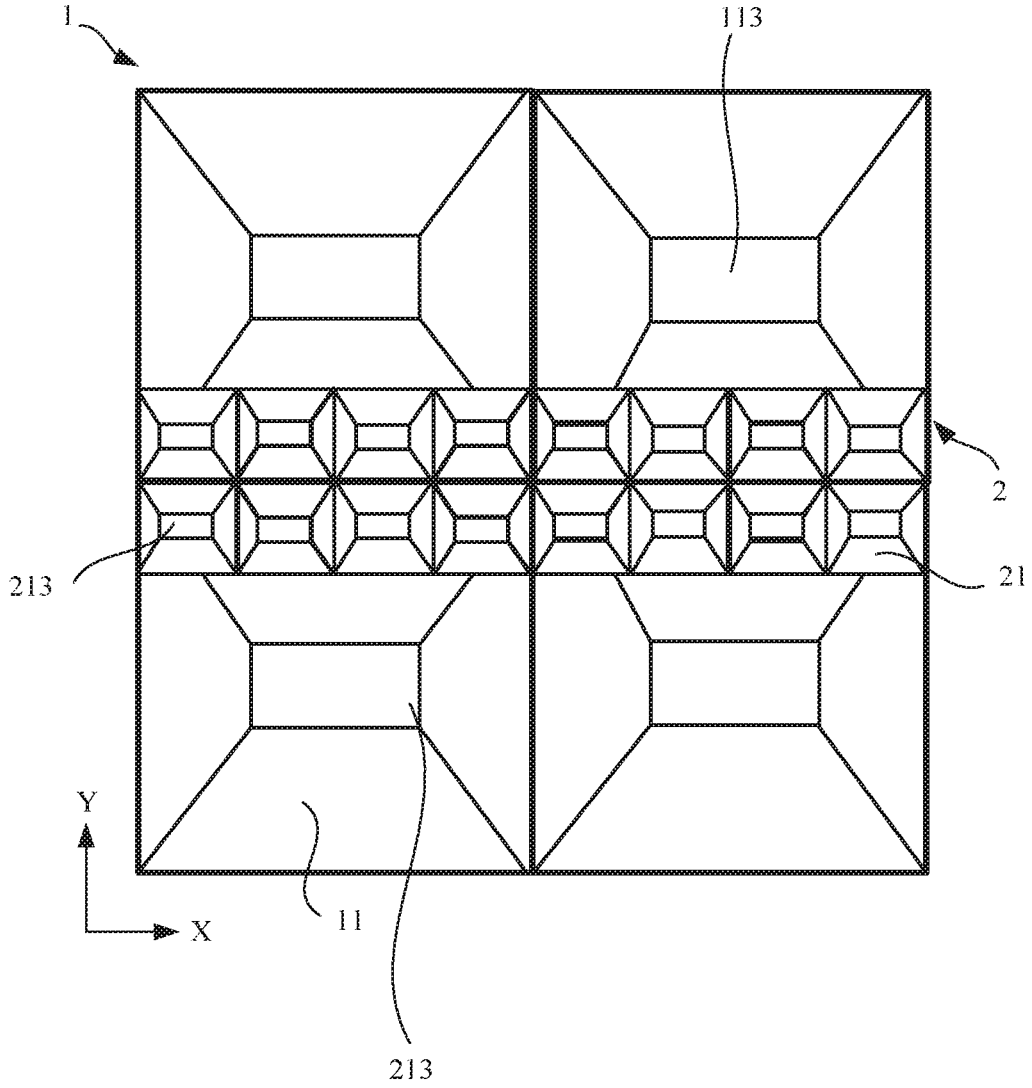
FIG. 4 is a main view of FIG. 3.

For ease of description of structures and relative positions of a low-frequency array element 11 and a high-frequency array element 21 in the feed apparatus provided in the embodiments of this application, as shown in FIG. 2 and FIG. 4, FIG. 2 and FIG. 4 show a structure form of embedding high-frequency feeds 2 into two low-frequency feeds 1. First, a direction of the feed apparatus is set, and an X direction and a Y direction are separately defined. The X direction is an extension direction of a wide aperture side of a low-frequency feeding port 113 when the low-frequency array element 11 has a square aperture and the low-frequency feeding port 113 has a rectangular aperture. The Y direction is an extension direction of a narrow aperture side of the low-frequency feeding port 113 when the low-frequency array element 11 has a square aperture and the low-frequency feeding port 113 has a rectangular aperture.

Figure 1:
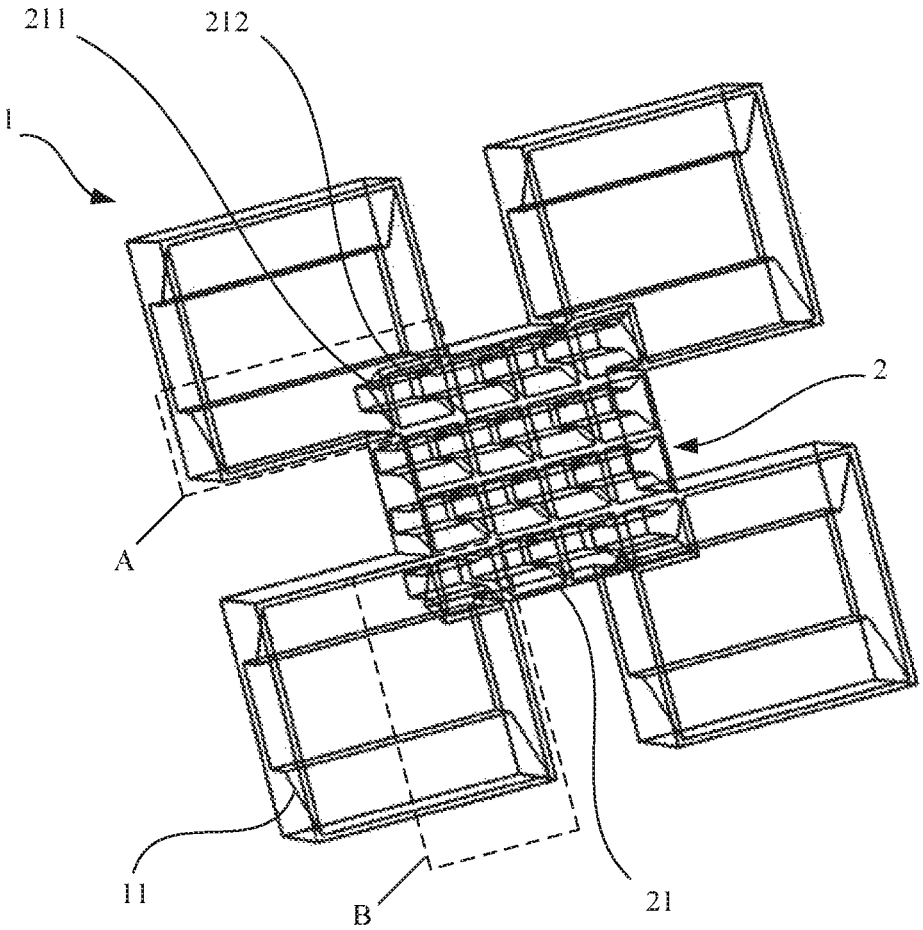
FIG. 1 is a schematic structural diagram of a feed apparatus according to an embodiment of this application.
Figure 3:
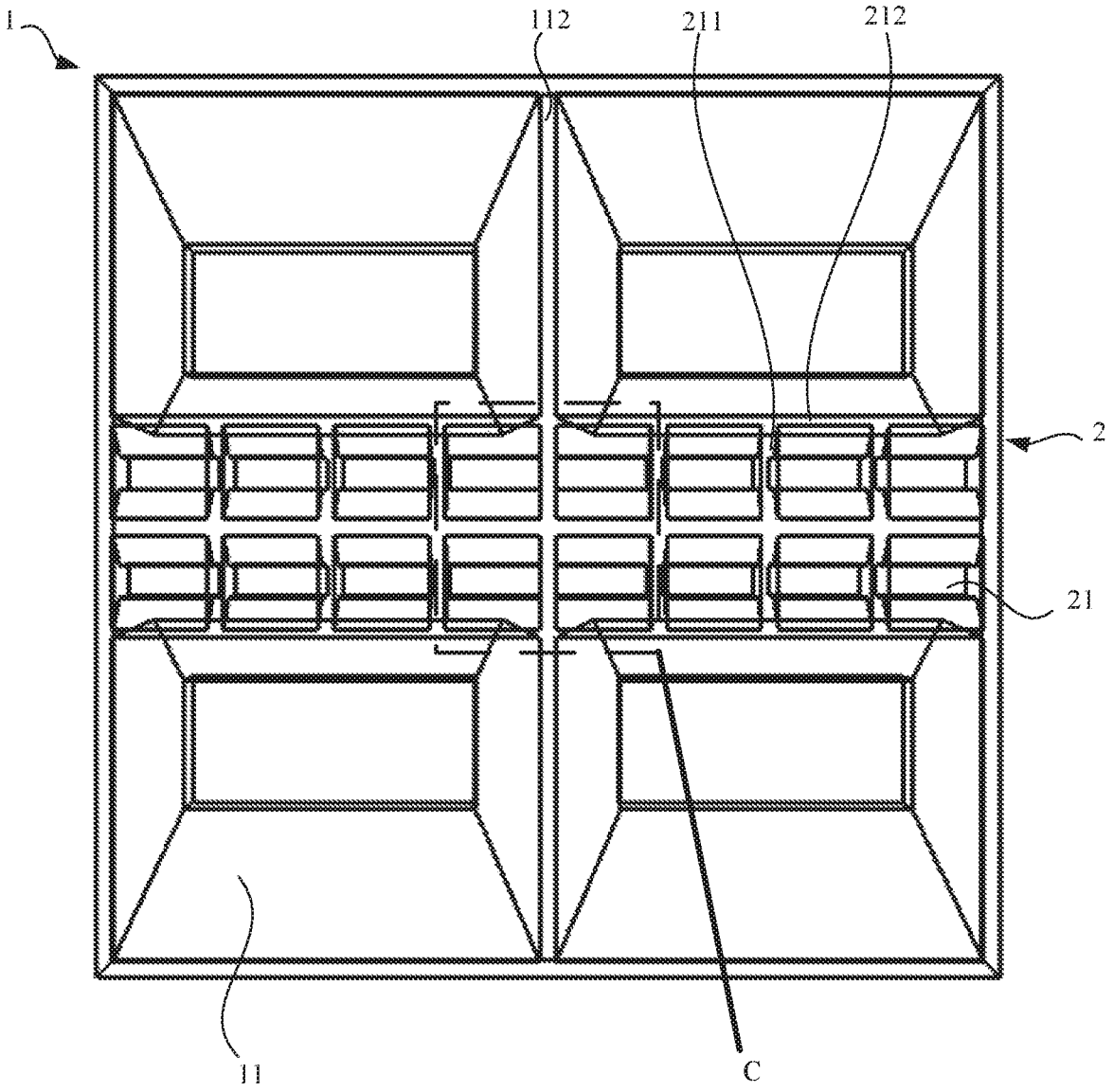
FIG. 3 is another schematic structural diagram of a feed apparatus according to an embodiment of this application.
Figure 7:
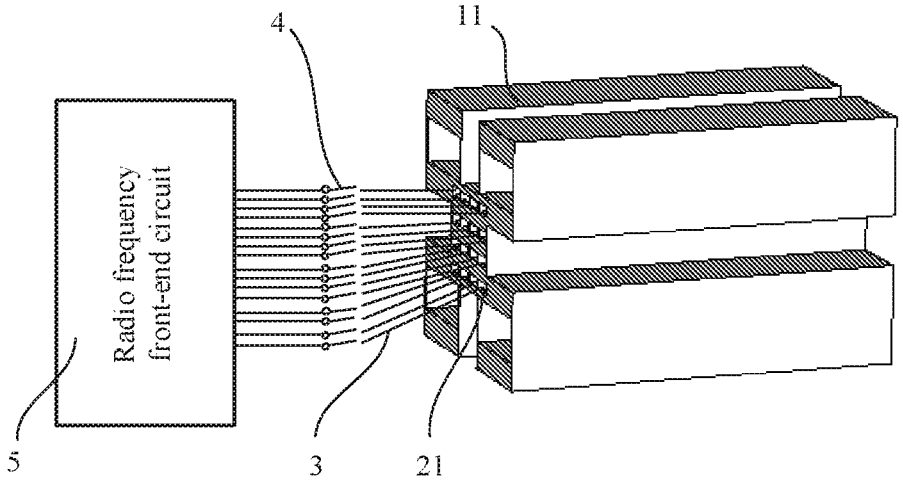
FIG. 7 is a schematic structural diagram of a dual-band microwave antenna according to an embodiment of this application.

As shown in FIG. 1, FIG. 2, FIG. 3. FIG. 4, and FIG. 7, FIG. 1 shows a structure in which the high-frequency array element 21 is embedded into and fits the low-frequency array element 11, FIG. 2 shows a position at which the high-frequency array element 21 is embedded into the low-frequency array element 11, FIG. 3 shows a structure in which the high-frequency array element 21 is embedded into and fits the low-frequency array element 11, FIG. 4 shows a schematic diagram of arrangement of the high-frequency array element 21 in the low-frequency array element 11, and FIG. 7 shows a cooperation relationship between a feed apparatus and a radio frequency front-end circuit 5. It can be learned from FIG. 1 and FIG. 3 that the feed apparatus includes a low-frequency feed 1 and a high-frequency feed 2. The high-frequency feed 2 is embedded into the low-frequency feed 1, and the high-frequency feed 2 may be embedded into a central position of the low-frequency feed 1 or may be embedded on one side of the low-frequency feed 1. The low-frequency feed 1 includes a plurality of low-frequency array elements 11 arranged in an array. A quantity of the low-frequency array elements 11 is N, where N≥4. It can be learned from FIG. 1, FIG. 2, FIG. 3, and FIG. 4 that the plurality of low-frequency array elements 11 may be arranged into a square array, or the plurality of low-frequency array elements 11 may be arranged into a circular array. The high-frequency feed 2 includes a plurality of high-frequency array elements 21 arranged in an array. It can be learned from FIG. 3 and FIG. 4 that the plurality of high-frequency array elements 21 may be arranged into a rectangular array. It can be learned from FIG. 1 and FIG. 2 that the plurality of high-frequency array elements 21 may alternatively be arranged into a square array. At least one high-frequency array element 21 is embedded into one low-frequency array element 11, only a plurality of high-frequency array elements 21 arranged in a row can be embedded into one low-frequency array element 11 in the X direction, and only one high-frequency array element 21 can be disposed in one low-frequency array element 11 in the Y direction. It can be learned from FIG. 1 and FIG. 2 that one high-frequency array element 21 is embedded into each low-frequency array element 11, where the embedded high-frequency array elements 21 are located in four corners of an array formed by a plurality of high-frequency array elements 21, and along the X direction, a plurality of high-frequency array elements 21 arranged in a row may be embedded into each low-frequency array element 11. It can be learned from FIG. 3 and FIG. 4 that all high-frequency array elements 21 are embedded into the low-frequency array element 11, and quantities of high-frequency array elements 21 in the low-frequency array elements 11 are the same. The low-frequency array element 11 and each high-frequency array element 21 embedded into the low-frequency array element 11 have a common waveguide wall. It can be learned from FIG. 1 that common waveguide walls between the low-frequency array element 11 and the high-frequency array element 21 are a first side wall 212 and a second side wall 211. It can be learned from FIG. 3 that the common waveguide wall between the low-frequency array element 11 and the high-frequency array element 21 is a side wall formed by connecting a plurality of first side walls 212 as a whole. In this case, it can be learned from FIG. 1 and FIG. 2 that adjacent high-frequency array elements 21 are fixed as a whole by sharing a side wall. It can be learned from FIG. 3 and FIG. 4 that adjacent high-frequency array elements 21 are fixed as a whole by sharing a second side wall 211, and adjacent low-frequency array elements 11 with no interval therebetween are directly fixed as a whole.

Therefore, in the foregoing, feed apparatus, the high-frequency feed 2 can be effectively integrated with the low-frequency feed 1 by using the common waveguide wall between the low-frequency array element 11 and the high-frequency array element 21 and a shared side wall between the high-frequency array elements 21, so that a structure of the feed apparatus is compact. The foregoing feed apparatus may be integrally formed through cutting and processing or the like, and is easy to process. In addition, a relatively compact structure of the feed apparatus enables the high-frequency feed 2 and the low-frequency feed 1 to be of good equalization. It can be learned from FIG. 7 that each high-frequency array element 21 is connected to a radio frequency switch 4 on a corresponding feeding tributary 3, and each high-frequency array element 21 may be electrically connected to the radio frequency front-end circuit 5 by controlling the radio frequency switch 4. Therefore, switching of the plurality of high-frequency array elements 21 can be implemented by using the radio frequency switches 4, and beam scanning of a dual-band microwave antenna 100 in a high frequency band can be further implemented, so that a beam width of a high-gain beam in the high frequency band can be increased to resist shaking. Therefore, a particular anti-shake capability is achieved in the high frequency band, and availability of a large-capacity high-frequency link can be improved while a standby function of a low-frequency link is reserved.

Figure 8:
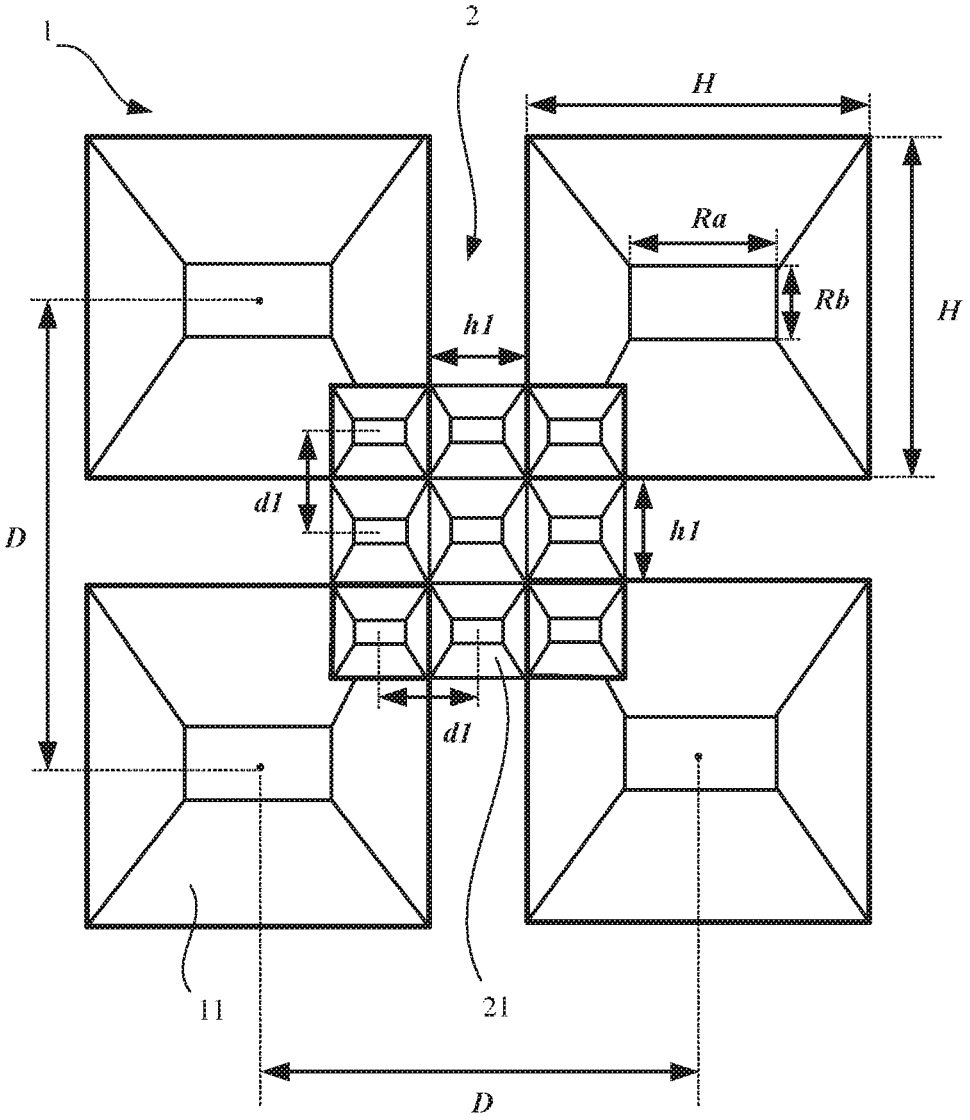
FIG. 8 is a schematic dimensional diagram of a feed apparatus according to an embodiment of this application.

When the high-frequency array element 21 is embedded into the low-frequency array element 11, to ensure a feeding function of a feeding apparatus, refer to FIG. 8. FIG. 8 shows a dimension relationship between the low-frequency array element 11 and the high-frequency array element 21. The low-frequency array element 11 includes the low-frequency feeding port 113 used for feeding, and the high-frequency array element 21 includes a high-frequency feeding port 213 used for feeding. The low-frequency array element 11 and each high-frequency array element 21 embedded into the low-frequency array element 11 are two array elements that perform feeding independently, and the low-frequency feeding port 113 of the low-frequency array element 11 is galvanically isolated from the high-frequency feeding port 213 of each high-frequency array element 21 embedded into the low-frequency array element 11. During specific disposition, the feeding apertures should meet the following relationship: a length of a narrow aperture side of the low-frequency feeding port 113 is less than a difference between an aperture length of the low-frequency array element 11 and twice an aperture length of the high-frequency array element 21. It can be learned from FIG. 1 and FIG. 2 that, one high-frequency array element 21 is embedded into each low-frequency array element 11, and the length of the narrow aperture side of the low-frequency feeding port 113 is far less than the difference between the aperture length of the low-frequency array element 11 and twice the aperture length of the high-frequency array element 21. It can be learned from FIG. 3 and FIG. 4 that, one high-frequency array element 21 is embedded into each low-frequency array element 11, and the length of the narrow aperture side of the low-frequency feeding port 113 is obviously less than the difference between the aperture length of the low-frequency array element 11 and twice the aperture length of the high-frequency array element 21. Although the high-frequency array element 21 is embedded into the low-frequency array element 11, during embedding, the high-frequency array element 21 is not embedded into the low-frequency feeding port 113 of the low-frequency array element 11. A position at which the high-frequency array element 21 is embedded into the low-frequency array element 11 may extend towards the low-frequency feeding port 113, but cannot contact with the low-frequency feeding port 113. In this way, it is ensured that the high-frequency feeding port 213 and the low-frequency feeding port 113 are isolated from each other, so that the low-frequency array element 11 and the high-frequency array element 21 perform feeding independently, and it is ensured that the low-frequency array element 11 and the high-frequency array element 21 can perform normal feeding after the high-frequency array element 21 is embedded into the low-frequency array element 11, to be specific, embedding of the high-frequency array element 21 into the low-frequency array element 11 does not affect feeding by the low-frequency array element 11, thereby ensuring the feeding function of the feeding apparatus. Therefore, the feeding apparatus integrates a plurality of high-frequency array elements 21 without affecting feeding by the low-frequency feed 1, thereby ensuring a compact structure and achieving a particular anti-shake capability in a high frequency band.

To avoid a grating lobe, on a basis of ensuring the feeding function of the feeding apparatus, still refer to FIG. 8. An interval length between adjacent low-frequency array elements 11 is less than an operating wavelength of the low-frequency array element 11, so that an interval distance between the low-frequency array elements 11 needs to meet a grating lobe suppression condition, and a grating lobe is suppressed by limiting the interval distance between the low-frequency array elements 11. An interval length between adjacent high-frequency array elements 21 is less than $1/(1+\sin\theta)$ times an operating wavelength of the high-frequency array element 21, where $\theta$ is a maximum scanning angle of the high-frequency feed 2, so that an interval distance between the high-frequency array elements 21 needs to meet a grating lobe suppression condition, and a grating lobe is suppressed by limiting the interval distance between the high-frequency array elements 21.

Figure 5:
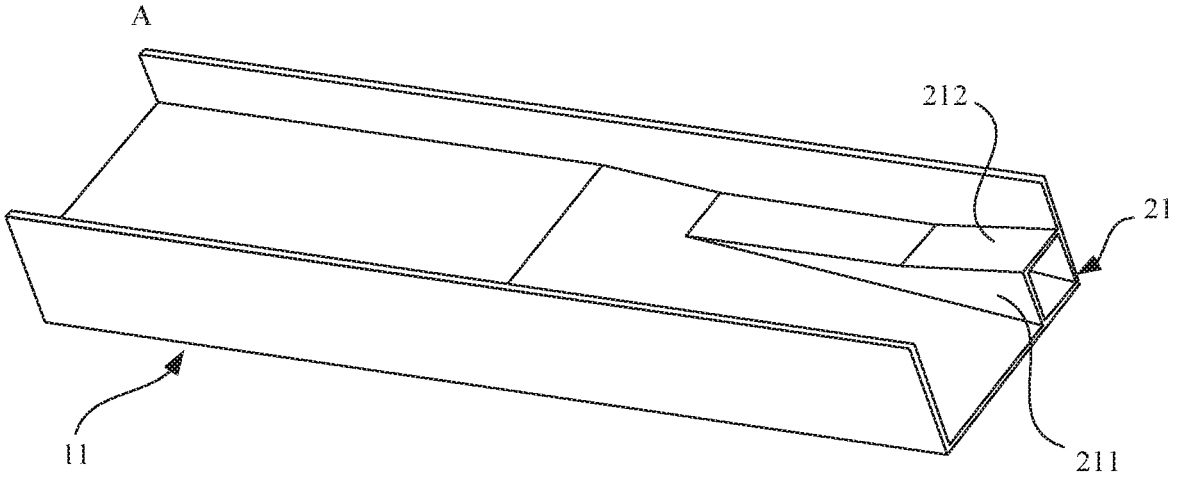
FIG. 5 is an enlarged schematic diagram of a position A in FIG. 1.
Figure 6:
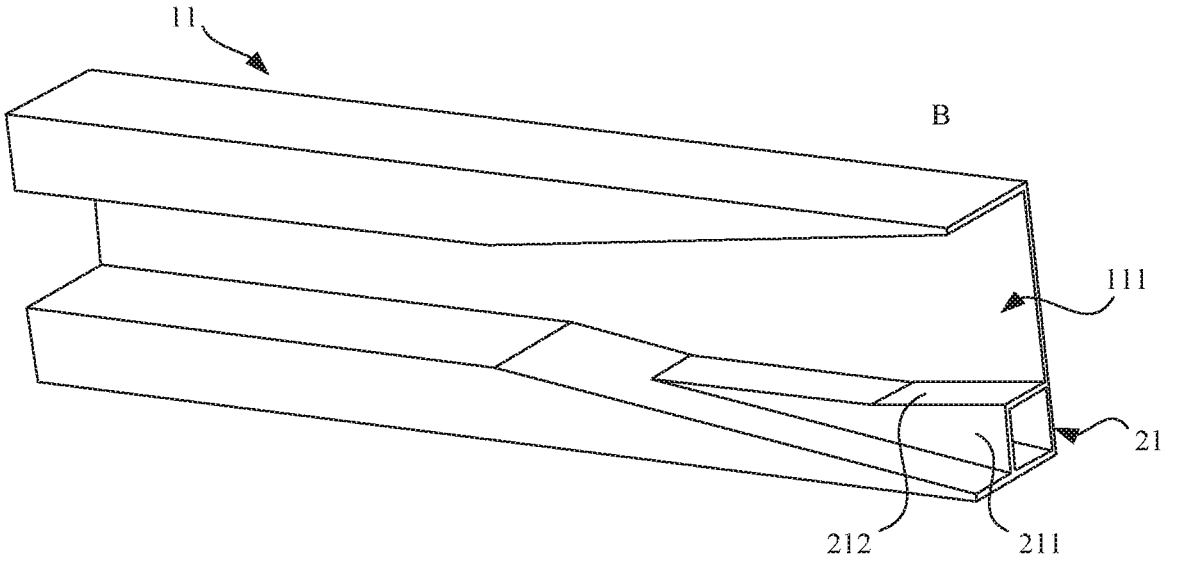
FIG. 6 is an enlarged schematic diagram of a position B in FIG. 1.

It can be learned from FIG. 1 that, the low-frequency array element 11 and the high-frequency array element 21 each are of a horn structure. In addition, refer to FIG. 5 and FIG. 6. FIG. 5 shows a specific structure of the high-frequency array element 21, and FIG. 6 shows a specific structure of the low-frequency array element 11. The low-frequency array element 11 is a first metal horn, and the high-frequency array element 21 is a second metal horn. It can be learned from FIG. 2 and FIG. 4 that the first metal horn and the second metal horn each have a square aperture, and the low-frequency feeding port 113 of the first metal horn and the high-frequency feeding port 213 of the second metal horn each have a rectangular aperture. In addition to the foregoing structures, the first metal horn and the second metal horn each may also have another aperture, for example, a rectangular aperture. During specific disposition, an aperture of the first metal horn is larger than an aperture of the second metal horn, to ensure that the first metal horn in the two metal horns is the low-frequency array element 11, and the second metal horn is the low-frequency array element 11.

To embed the high-frequency array element 21 into the low-frequency array element 11, it can be learned from FIG. 6 and FIG. 7 that the second metal horn has a first side wall 212 and a second side wall 211. The first side wall 212 is adjacent and connected to the second side wall 211. The first metal horn includes a horn mouth 111, the second metal horn is embedded into the first metal horn, and the first side wall 212 and the second side wall 211 are located in the horn mouth 111. It can be learned from FIG. 1 and FIG. 2 that one second metal horn is embedded into each first metal horn, the first side wall 212 and the second side wall 211 are common waveguide walls of the first metal horn and the second metal horn, and the first metal horn and the second metal horn embedded into the first metal horn are connected as a whole by using the first side wall 212 and the second side wall 211. It can be learned from FIG. 3 and FIG. 4 that a plurality of second metal horns are embedded into each first metal horn, in each first metal horn, adjacent second metal horns share a second side wall 211, and a plurality of first side walls 212 are connected to form an integrated structure. The integrated structure is a common waveguide wall of the first metal horn and the second metal horn.

To effectively integrate the high-frequency feed 2 with the low-frequency feed 1 to make the structure of the feed apparatus compact, during specific disposition, as shown in FIG. 1 and FIG. 3, FIG. 1 shows that there is an interval between first metal horns, and FIG. 3 shows that there is no interval between the first metal horns. However, regardless of whether there is an interval between the first metal horns, two adjacent first metal horns are fixedly connected. When there is an interval between the first metal horns, at least one second metal horn is disposed within the interval between the first metal horns. It can be learned from FIG. 1 that when there is an interval between the first metal horns, two second metal horns are disposed within the interval between the first metal horns. In this case, the two second metal horns are connected by sharing a side wall by the two second metal horns, and the two second metal horns are connected to the first metal horn by sharing side walls by the two second metal horns and the first metal horn. Therefore, two adjacent first metal horns are fixedly connected by using at least one second metal horn, and a first metal horn and a second metal horn are fixedly connected by using a first side wall 212 and a second side wall 211, to form a feed structure in which the high-frequency feed 2 and the low-frequency feed 1 are integrated, thereby ensuring structural stability. It can be learned from FIG. 3 that when there is no interval between the first metal horns, two adjacent first metal horns may be fixedly connected by fixing end surfaces 112 of horn mouths 111 of the two adjacent first metal horns as a whole, or two adjacent first metal horns may be fixedly connected by sharing a side wall by the two adjacent first metal horns. The plurality of second horns are all embedded into the first metal horn. When a quantity of the second metal horns is equal to 4, the four second metal horns are respectively embedded into four first metal horns. When a quantity of the second metal horns is greater than 4, the plurality of second metal horns are arranged in two rows along the X direction and at least two second metal horns embedded into the first metal horn are arranged in a row. When there is an interval between the first metal horns, a plurality of second metal horns that are arranged in a row may be embedded into each first metal horn along the X direction.

In addition, as shown in FIG. 7, this application provides a dual-band microwave antenna 100. The dual-band microwave antenna 100 may be a Cassegrain antenna, or may be a reflector antenna such as a ring-focus antenna, or may be various reflection arrays, dielectric lenses, or various transmission array antennas. FIG. 7 shows a specific structure of the dual-band microwave antenna 100, including the feed apparatus according to any one of the foregoing technical solutions, and further including a feeding tributary 3. Radio frequency switches 4 respectively corresponding to high-frequency array elements 21 are disposed on the feeding tributary 3, and the radio frequency switch 4 is configured to control switching of the high-frequency array element 21, to implement a connection and a disconnection between the radio frequency front-end circuit 5 and the high-frequency array element 21. A phase center of a feed formed by four array elements in a central area of the high-frequency feed 2 coincides with a focus of the Cassegrain antenna. In the foregoing dual-band microwave antenna 100, switching of the high-frequency array element 21 is controlled by an action of the radio frequency switch 4, to implement beam scanning of the dual-band microwave antenna 100 in a high frequency band, thereby improving availability of a large-capacity high-frequency link in a dual-band antenna transmission system, and reserving a standby function of a low-frequency link.

The following uses the feed apparatus shown in FIG. 3 and FIG. 4 as an example to describe the fact that an anti-shake capability of the dual-band microwave antenna 100 is relatively high. A diameter of a primary reflector of the Cassegrain antenna is set to 660 mm, a diameter of a secondary reflector is set to 100 mm, a feed radiation angle is set to 32 degrees, and a focus-diameter ratio is set to 0.385. Referring to FIG. 8, the low-frequency array element 11 is selected to operate in a common frequency band (15 GHz), the high-frequency array element 21 is selected to operate in an E-band, an aperture length H of the low-frequency array element 11 is set to 13 mm, an interval distance D between the low-frequency array elements 11 is set to 13.5 mm, a wide aperture side Ra of the low-frequency feeding port 113 is set to 9 mm, a narrow aperture side Rb of the low-frequency feeding port 113 is set to 4 mm, a length of a radiation section of the low-frequency array element 11 is set to 20 mm, a length of a feeding waveguide section of the low-frequency array element 11 is set to 20 mm, a thickness of a waveguide wall of the low-frequency array element 11 is set to 0.25 mm, an aperture length h1 of the high-frequency array element 21 is set to 2.25 mm, an interval distance d1 between the high-frequency array elements 21 is set to 2.75 mm, a length of a radiation section of the high-frequency array element 21 is set to 5.2 mm, a length of a feeding waveguide section of the high-frequency array element 21 is set to 34.8 mm, the high-frequency array element 21 embedded into the aperture of the low-frequency array element 11 shares the first side wall 212 with the low-frequency array element 11, and a thickness of the first side wall 212 is set to 0.25 mm.

Referring to FIG. 7, FIG. 10, FIG. 11 FIG. 12, FIG. 13, and FIG. 14, FIG. 3 shows that a square array is formed by every four second metal horns (in a 2×2 form) in a high frequency band to form an E-band feed C, and through switching of the radio frequency switch 4 in FIG. 7, there may be (2×N−1) operating states for 4×N high-frequency array elements 21, to implement (2×N−1) beam scannings in one dimension. It can be learned from FIG. 10 that a feed gain at 15 GHz in the feed apparatus is 14.5 dBi. It can be learned from FIG. 11 that a feed gain at 86 GHz in the feed apparatus is 14.6 dBi. Feed gains in a low frequency band and a high frequency band are approximately the same. Therefore, the feed apparatus operating at the two frequency bands has relatively desirable equalization. It can be learned from FIG. 12 that the Cassegrain antenna has a gain of 37.4 dBi at 15 GHz and a 3 dB beam width of 2.1 degrees. It can be learned from FIG. 13 that the Cassegrain antenna has a gain of 52.6 dBi at 86 GHz and a 3 dB beam width of 0.4 degree in an azimuth plane and a pitch plane. It can be learned from FIG. 14 that, through switching, the high-frequency feed 2 has seven operating states, and seven beam scannings of the dual-band microwave antenna 100 in the high frequency band in a horizontal direction can be implemented, so that a horizontal beam width of the dual-band microwave antenna 100 is increased from 0.4 degree to 2 degrees. The horizontal beam width of the dual-band microwave antenna 100 is increased to effectively resist shaking in the horizontal direction, thereby improving the anti-shake capability of the dual-band microwave antenna 100.

The following uses the feed apparatus shown in FIG. 1 and FIG. 2 as an example to describe the fact that an anti-shake capability of the dual-band microwave antenna 100 is relatively high. A diameter of a primary reflector of the Cassegrain antenna is set to 660 mm a diameter of a secondary reflector is set to 100 mm a feed radiation angle is set to 32 degrees, and a focus-diameter ratio is set to 0.385. Referring to FIG. 8, the low-frequency array element 11 is selected to operate in a common frequency band (15 GHz), the high-frequency array element 21 is selected to operate in an E-band, an aperture length H of the low-frequency array element 11 is set to 9.5 mm, an interval distance D between the low-frequency array elements 11 is set to 15 mm, a wide aperture side Ra of the low-frequency feeding port 113 is set to 9.5 mm, a narrow aperture side Rb of the low-frequency feeding port 113 is set to 4.5 mm, a length of a radiation section of the low-frequency array element 11 is set to 20 mm, a length of a feeding waveguide section of the low-frequency array element 11 is set to 20 mm, a thickness of a waveguide wall of the low-frequency array element 11 is set to 0.25 mm, an aperture length h1 of the high-frequency array element 21 is set to 2.25 mm, an interval distance d1 between the high-frequency array elements 21 is set to 2.75 mm, a length of a radiation section of the high-frequency array element 21 is set to 5.2 mm, a length of a feeding waveguide section of the high-frequency array element 21 is set to 34.8 mm, the high-frequency array element 21 embedded into the aperture of the low-frequency array element 11 shares the first side wall 212 and the second side wall 211 with the low-frequency array element 11, and thicknesses of the first side wall 212 and the second side wall 211 are set to 0.25 mm.

Referring to FIG. 15, FIG. 16, FIG. 17, FIG. 18, and FIG. 19, FIG. 1 shows a structure form in which 4×4 high-frequency array elements 21 are embedded into a central area of the low-frequency array element 11, an array is formed by every four high-frequency array elements 21 (in a 2×2 form) to form an E-band feed C, and through switching of the radio frequency switch 4, there may be 3×3 operating states for 4×4 high-frequency array elements 21, to implement beam scannings in nine states in two dimensions. It can be learned from FIG. 15 that a feed gain at 15 GHz in the feed apparatus is 12.2 dBi. It can be learned from FIG. 16 that a feed gain at 86 GHz in the feed apparatus is 14.5 dBi. Feed gains in a low frequency band and a high frequency band are close. Therefore, the feed apparatus operating at the two frequency bands has relatively desirable equalization. It can be learned from FIG. 17 that the Cassegrain antenna has a gain of 35.6 dBi at 15 GHz and a 3 dB beam width of 1.9 degrees. It can be learned from FIG. 18 that a Cassegrain antenna has a gain of 52.4 dBi at 86 GHz and a 3 dB beam width of 0.4 degree in an azimuth plane and a pitch plane. It can be learned from FIG. 19 that, through switching, the high-frequency feed 2 has nine operating states, and nine beam scannings of the dual-band microwave antenna 100 in the high frequency band in a horizontal direction and a vertical direction can be implemented, so that a horizontal beam width of the dual-band microwave antenna 100 is increased from 0.4 degree to 0.9 degree, a vertical beam width of the dual-band microwave antenna 100 is increased from 0.4 degree to 0.9 degree. The horizontal beam width of the dual-band microwave antenna 100 is increased to effectively resist shaking in the horizontal direction, and the vertical beam width of the dual-band microwave antenna 100 is increased to effectively resist shaking in the vertical direction, thereby improving the anti-shake capability of the dual-band microwave antenna 100.

Figure 9:
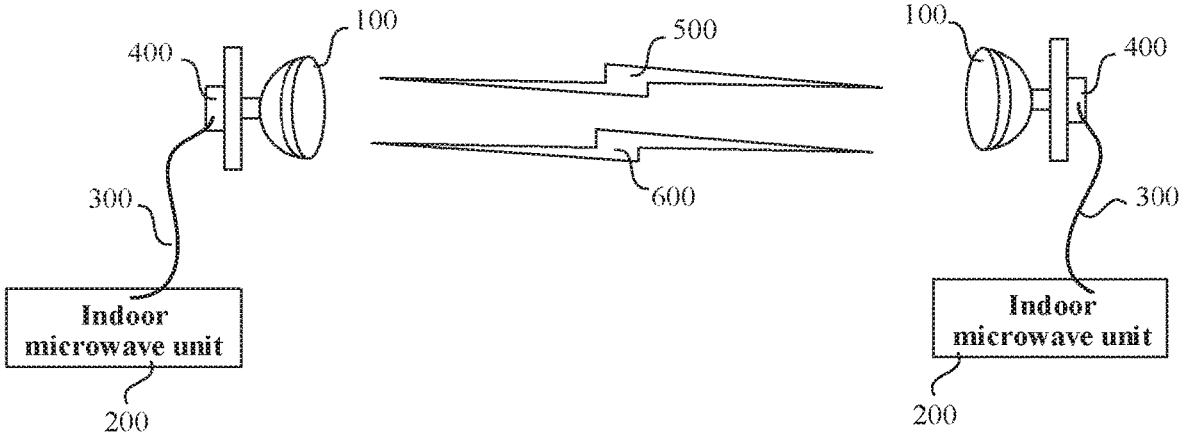
FIG. 9 is a schematic structural diagram of a dual-band antenna device according to an embodiment of this application.
Figure 10:
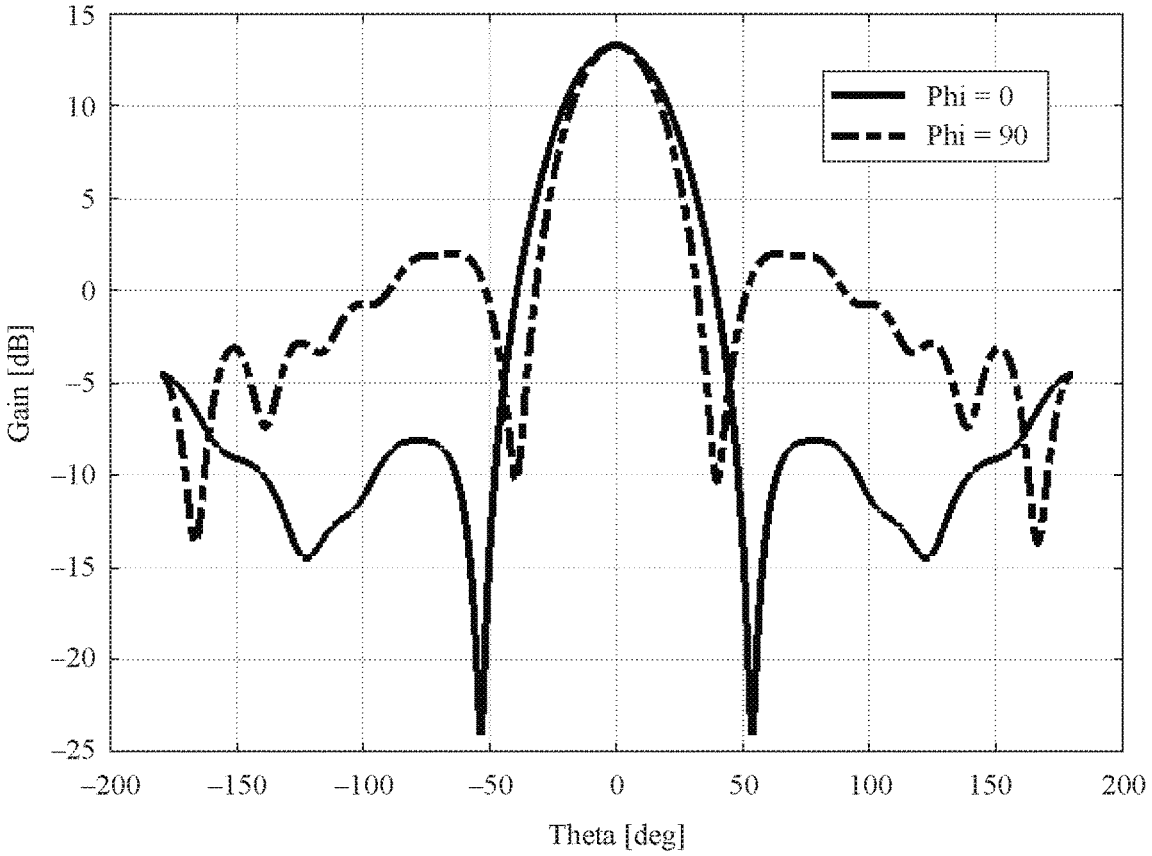
FIG. 10 is a feed gain pattern at 15 GHz in the feed apparatus provided in FIG. 3.
Figure 11:
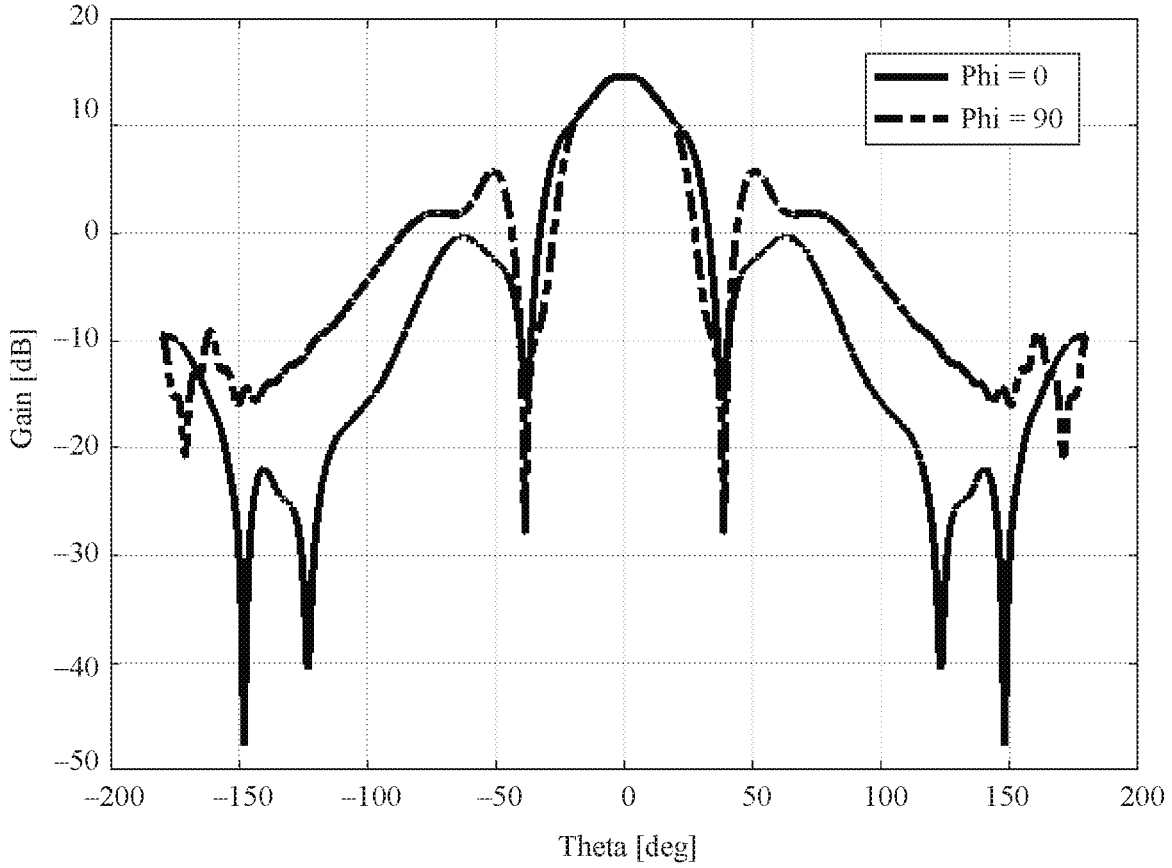
FIG. 11 is a feed gain pattern at 86 GHz in the feed apparatus provided in FIG. 3.
Figure 12:
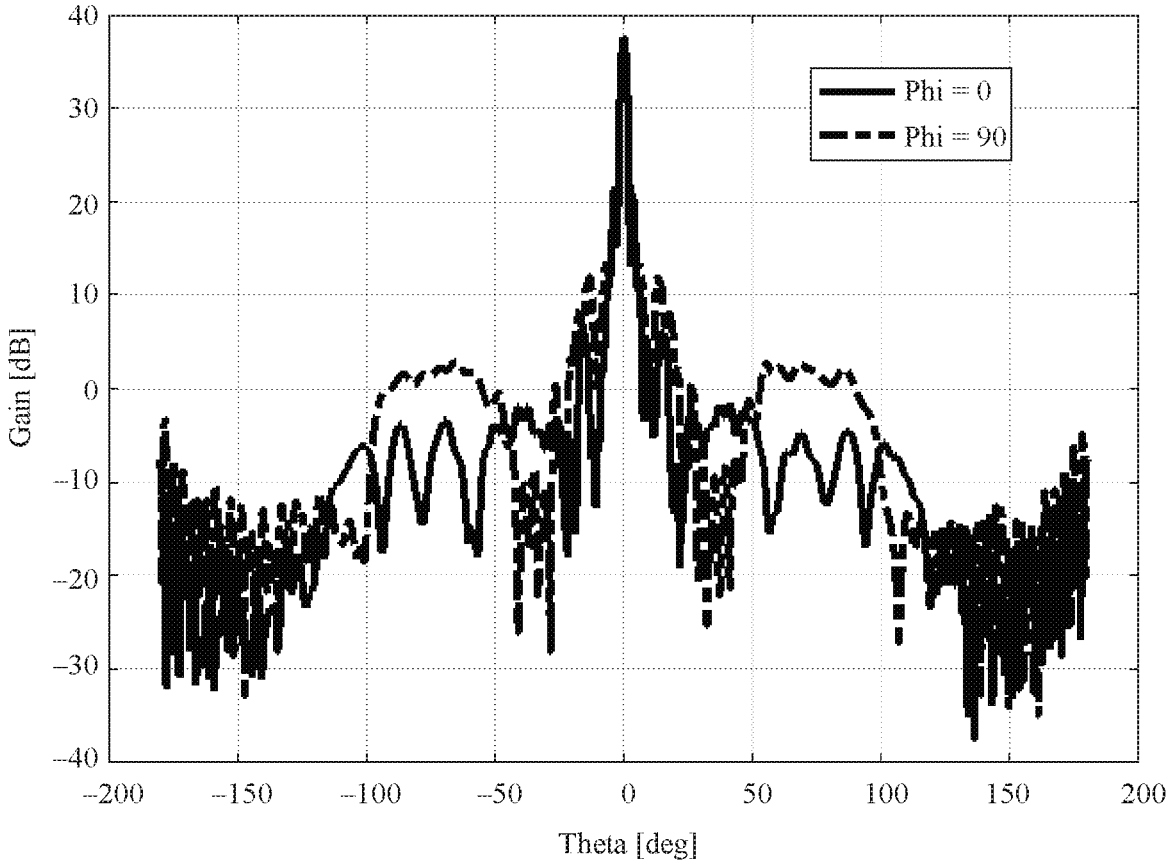
FIG. 12 is a gain pattern of a Cassegrain antenna using the feed apparatus provided in FIG. 3 at 15 GHz.
Figure 13:
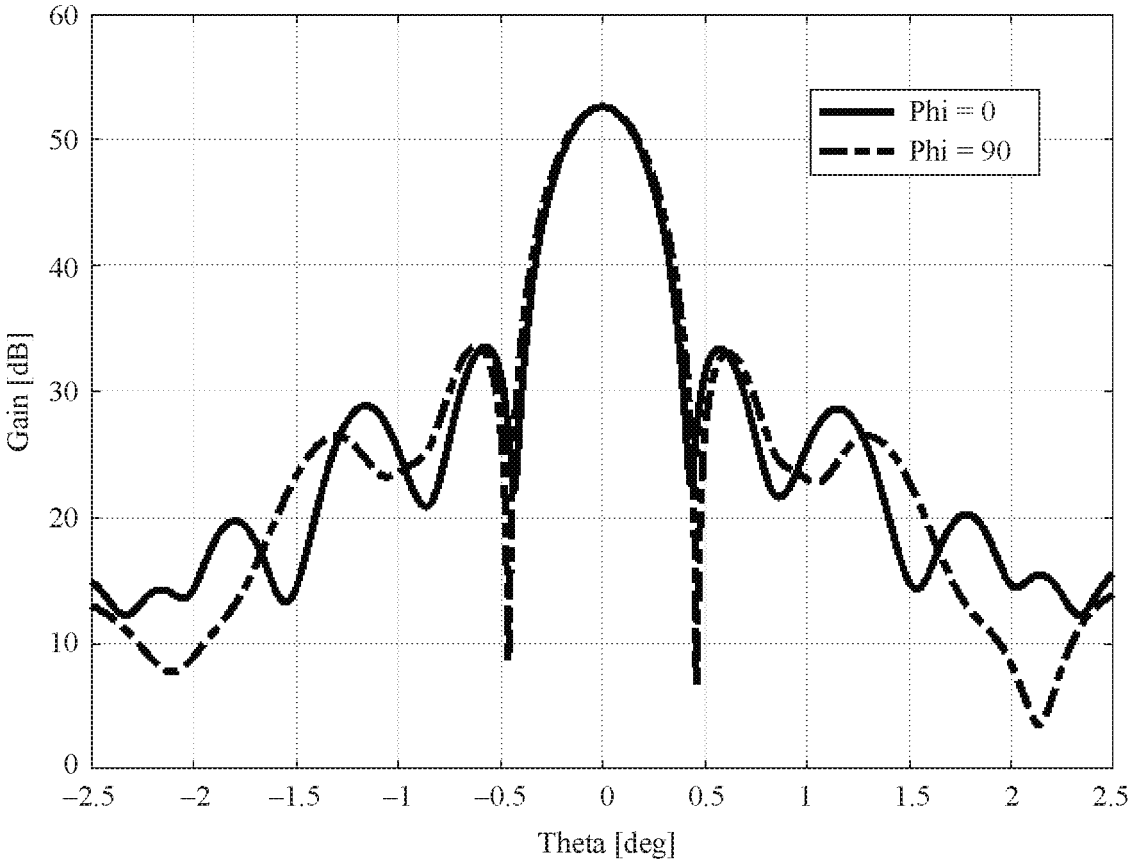
FIG. 13 is a gain pattern of a Cassegrain antenna using the feed apparatus provided in FIG. 3 at 86 GHz.
Figure 14:
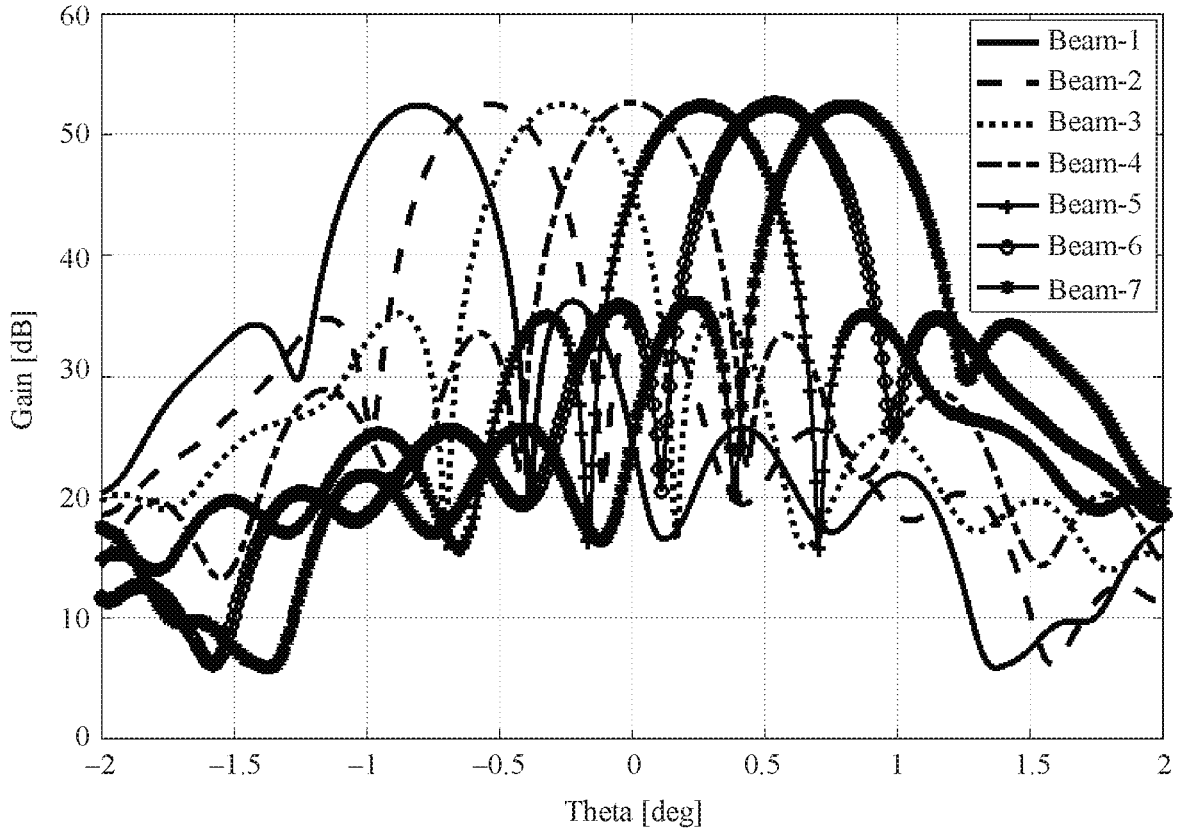
FIG. 14 shows a beam scanning range of a Cassegrain antenna using the feed apparatus provided in FIG. 3 at 86 GHz in a horizontal direction.
Figure 15:
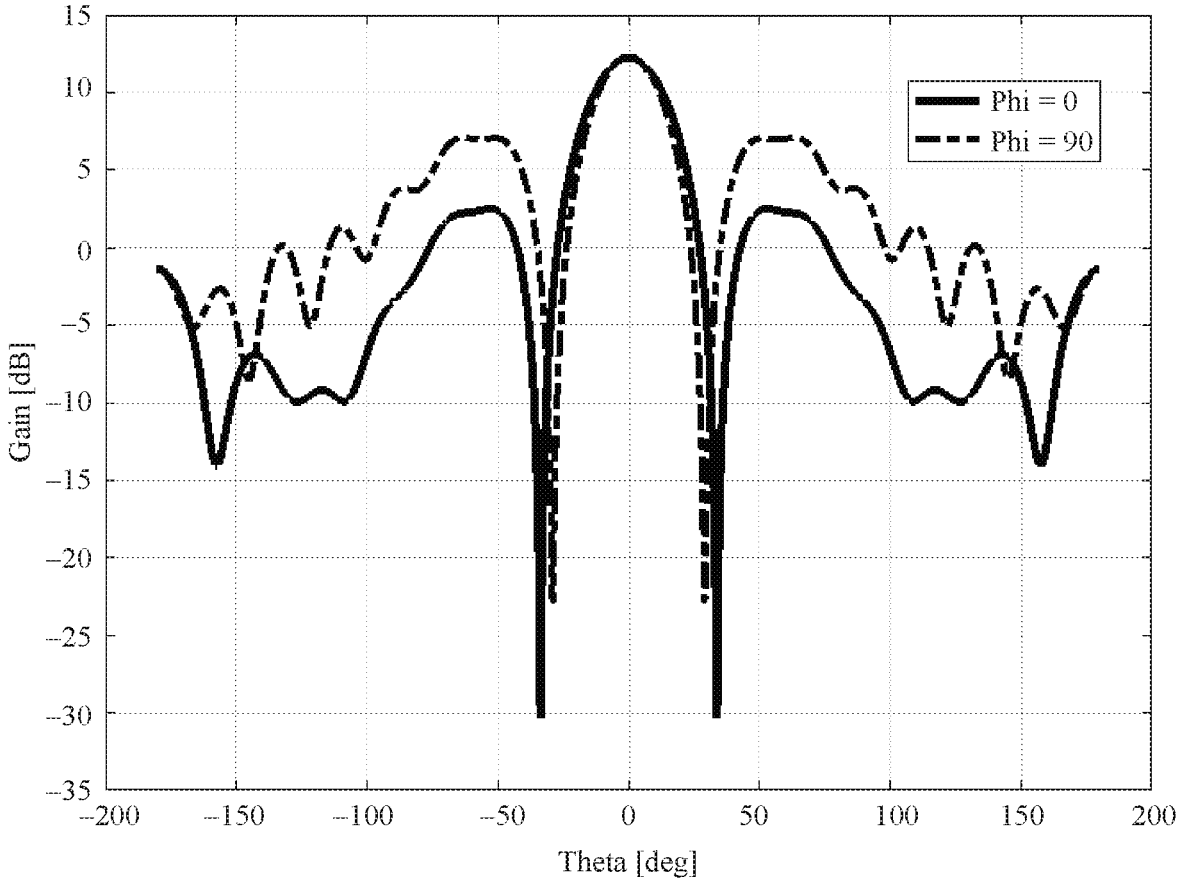
FIG. 15 is a feed gain pattern at 15 GHz in the feed apparatus provided in FIG. 1.
Figure 16:
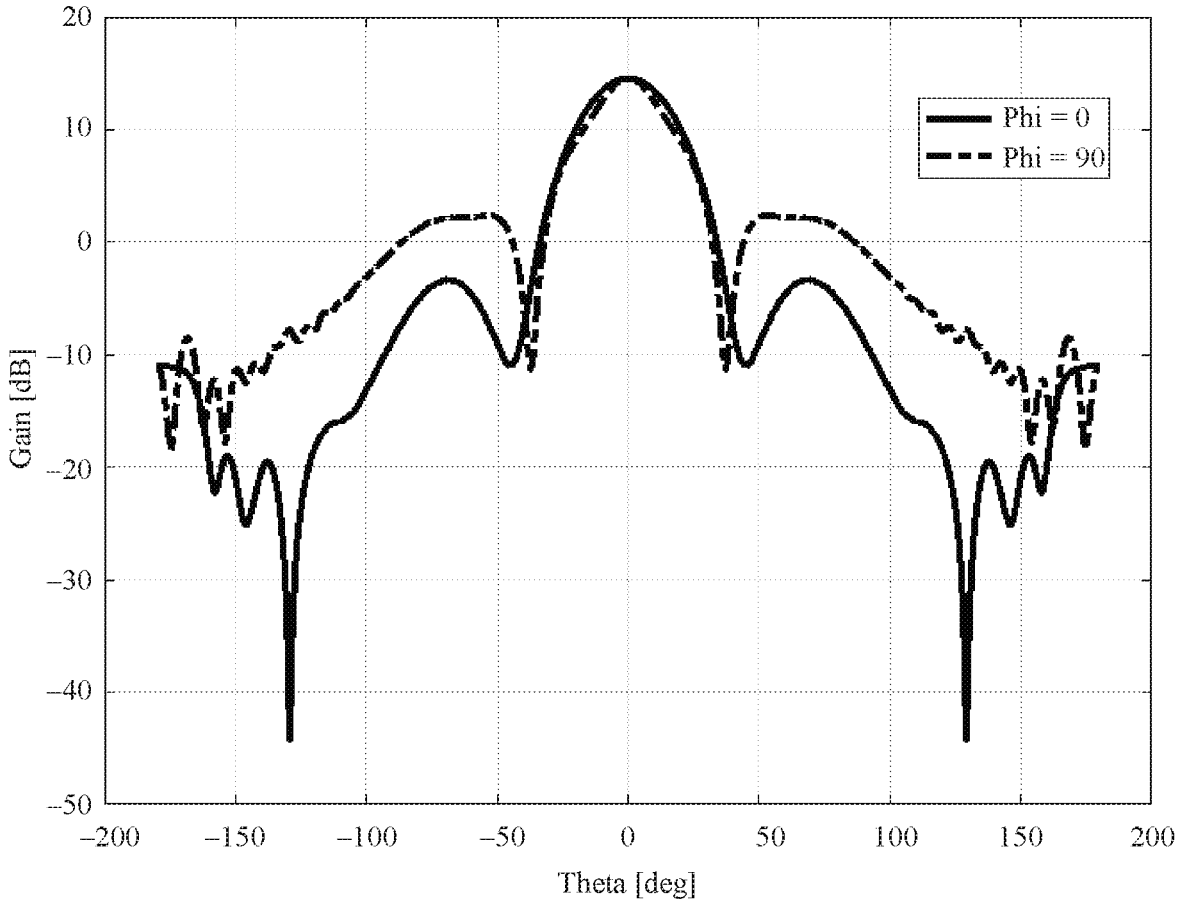
FIG. 16 is a feed gain pattern at 86 GHz in the feed apparatus provided in FIG. 1.
Figure 17:
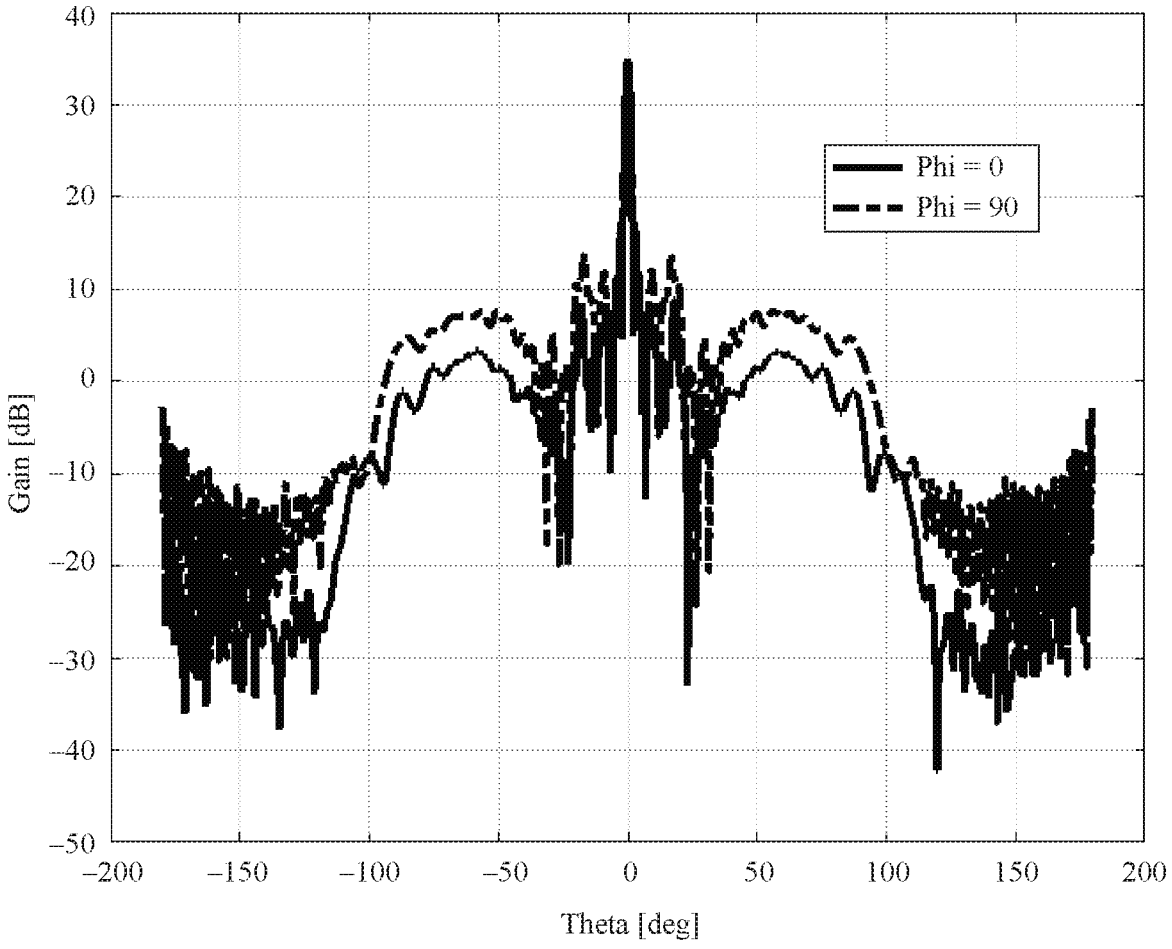
FIG. 17 is a gain pattern of a Cassegrain antenna using the feed apparatus provided in FIG. 1 at 15 GHz.
Figure 18:
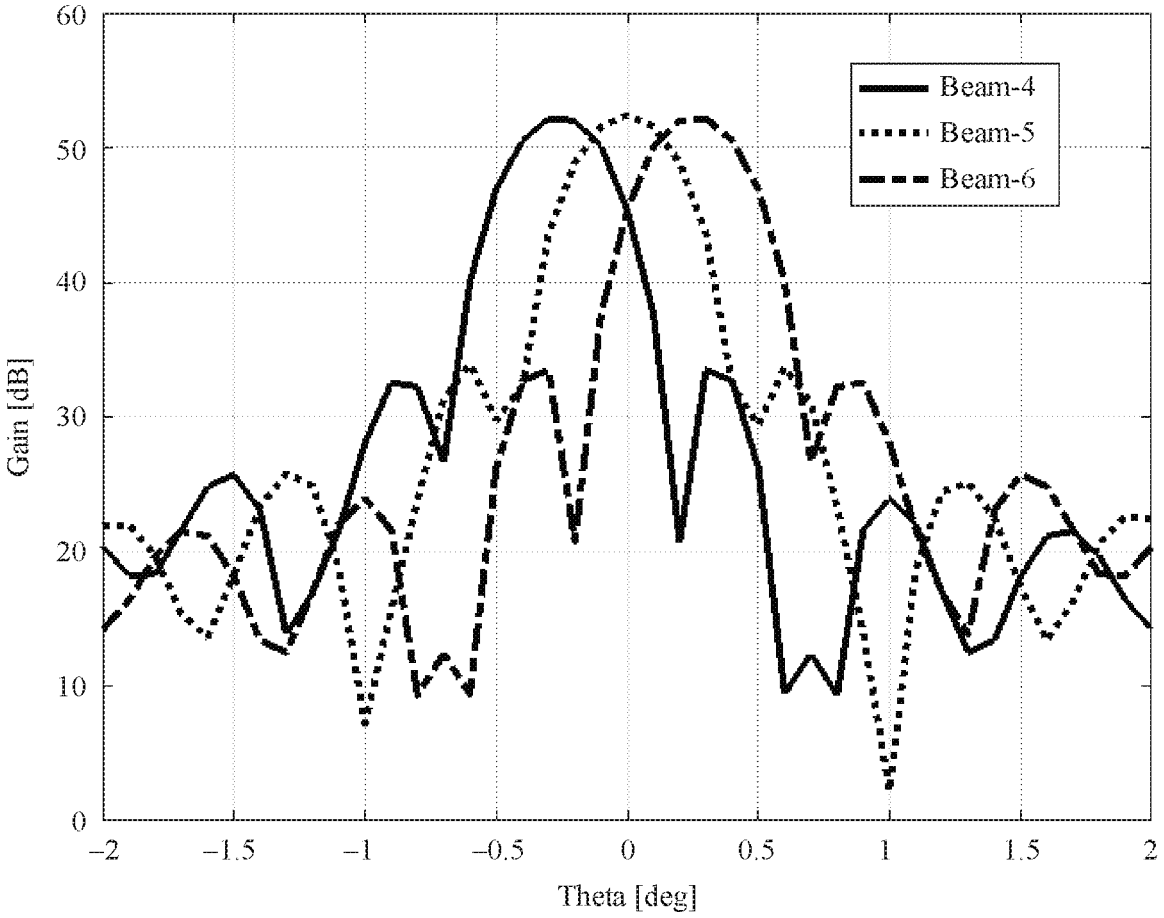
FIG. 18 is a gain pattern of a Cassegrain antenna using the feed apparatus provided in FIG. 1 at 86 GHz.
Figure 19:
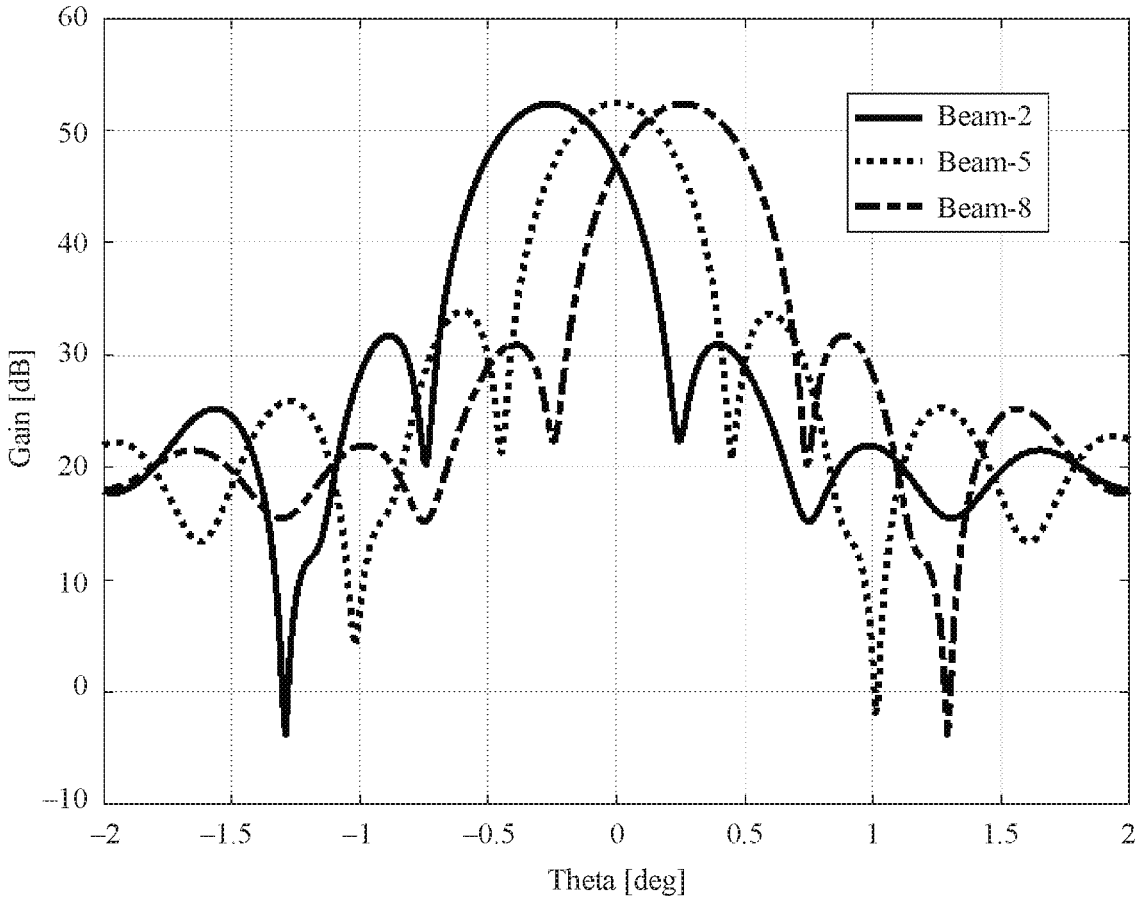
FIG. 19 shows a beam scanning range of a Cassegrain antenna using the feed apparatus provided in FIG. 1 at 86 GHz in a horizontal direction.

In addition, as shown in FIG. 9, this application provides a dual-band antenna device. The dual-band antenna device may be a microwave device. FIG. 9 shows that two microwave devices form a one-hop device, and the two microwave devices may form a network system or a part of a network system. Any microwave device may include an indoor microwave unit 200 and an outdoor microwave unit 400 in signal connection with the indoor microwave unit 200, and includes the dual-band microwave antenna 100 according to any one of the foregoing technical solutions. The dual-band microwave antenna 100 is connected to the outdoor microwave unit 400 by using a feeding waveguide. In a separated dual-band microwave transmission system, in a receiving direction, a dual-band microwave antenna 100 of a local device receives a radio frequency signal sent by an antenna of a peer device. The outdoor microwave unit 400 performs frequency conversion and amplification on the received radio frequency signal, converts the radio frequency signal into an analog intermediate-frequency signal, and transmits the analog intermediate-frequency signal to the indoor microwave unit 200 through an intermediate-frequency cable 300. The indoor microwave unit 200 demodulates and digitalizes the received analog intermediate-frequency signal, and decomposes the analog intermediate-frequency signal into a digital signal, thereby implementing a receiving function of the dual-band microwave antenna 100. In a transmitting direction, the indoor microwave unit 200 modulates a baseband digital signal into an analog intermediate-frequency signal, and transmits the analog intermediate-frequency signal to the outdoor microwave unit 400 through the intermediate-frequency cable 300. The outdoor microwave unit 400 performs up-conversion and amplification on the transmitted analog intermediate-frequency signal and converts the analog intermediate-frequency signal into a radio frequency signal at a specific frequency, and then sends the radio frequency signal in a direction of the antenna of the peer device by using the dual-band microwave antenna 100 of the local device. The outdoor microwave unit 400 includes a high-frequency outdoor unit used for high-band (for example, E-band) radio frequency signal access, and a low-frequency outdoor unit used for low-band (for example, 15 GHz, 18 GHz, or 23 GHz) radio frequency signal access. The dual-band antenna supports transmission using a same plane of the dual-band microwave antenna 100 in a low frequency band and a high frequency band. In the separated dual-band microwave transmission system, a low-band link 500 is bound to a high-band link 600, to enable the dual-band microwave antenna 100 to perform transmission in a same dual-band microwave antenna in both the low frequency band and the high frequency band, so that a beam width of the high-band antenna can be effectively increased while a large bandwidth is used and a transmission distance is increased. In this way, the dual-band microwave antenna 100 achieves an anti-shake capability in the high frequency band, and availability of the high-band link 600 is improved.

The foregoing descriptions are merely specific implementations of the present invention, but are not intended to limit the protection scope of the present invention. Any variation or replacement readily figured out by a person skilled in the art within the technical scope disclosed in the present invention shall fall within the protection scope of the present invention. Therefore, the protection scope of the present invention shall be subject to the protection scope of the claims.

What is claimed is:

1. A feed apparatus, comprising:

a low-frequency feed; and a high-frequency feed embedded into the low-frequency feed, wherein the low-frequency feed comprises a plurality of low-frequency array elements arranged in an array, the high-frequency feed comprises a plurality of high-frequency array elements arranged in an array, at least one high-frequency array element is embedded into one low-frequency array element, and the one low-frequency array element and each high-frequency array element embedded into the one low-frequency array element have a common waveguide wall.

2. The feed apparatus according to claim 1, wherein the one low-frequency array element and each high-frequency array element embedded into the one low-frequency array element are two array elements that perform feeding independently.

3. The feed apparatus according to claim 2, wherein the one low-frequency array element comprises a low-frequency feeding port used for feeding, each high-frequency array element embedded into the one low-frequency array element comprises a high-frequency feeding port used for feeding, and the low-frequency feeding port of the one low-frequency array element is galvanically isolated from the high-frequency feeding port.

4. The feed apparatus according to claim 3, wherein each of the one low-frequency array element and the at least one high-frequency array element embedded into the one low-frequency array element has a square aperture, each of the low-frequency feeding port and the high-frequency feeding port has a rectangular aperture, and a length of a narrow aperture side of the low-frequency feeding port is less than a difference between an aperture length of the one low-frequency array element and twice of an aperture length of the at least one high-frequency array element embedded into the one low-frequency array element.

5. The feed apparatus according to claim 1, wherein the one low-frequency array element is a first metal horn, the at least one high-frequency array element embedded into the one low-frequency array element is a second metal horn, and an aperture of the first metal horn is larger than an aperture of the second metal horn.

6. The feed apparatus according to claim 5, wherein the second metal horn has a first side wall and a second side wall that are adjacent to each other, the first metal horn comprises a horn mouth, the second metal horn is embedded into the first metal horn, and the first side wall and the second side wall are located in the horn mouth.

7. The feed apparatus according to claim 5, wherein the low-frequency feed comprises at least four first metal horns, and two adjacent first metal horns are fixedly connected.

8. The feed apparatus according to claim 7, wherein end surfaces of horn mouths of the two adjacent first metal horns are fixed as a whole, and a plurality of second metal horns are embedded into the first metal horns.

9. The feed apparatus according to claim 7, wherein the two adjacent first metal horns are fixedly connected by using at least one second metal horn.

10. The feed apparatus according to claim 8 wherein at least one second metal horn embedded into the first metal horns is arranged in a row along an extension direction of a wide aperture side of a low-frequency feeding port of the one low-frequency array element.

11. The feed apparatus according to claim 1, wherein an interval length between adjacent low-frequency array elements is less than an operating wavelength of the one low-frequency array element.

12. The feed apparatus according to claim 1, wherein an interval length between adjacent high-frequency array elements is less than $1/(1+\sin\theta)$ times an operating wavelength of the at least one high-frequency array element embedded into the one low-frequency array element, wherein $\theta$ is a maximum scanning angle of the high-frequency feed.

13. A dual-band microwave antenna, comprising:

a feed apparatus, wherein the feed apparatus comprises a low-frequency feed and a high-frequency feed embedded into the low-frequency feed, the low-frequency feed comprises a plurality of low-frequency array elements arranged in an array, the high-frequency feed comprises a plurality of high-frequency array elements arranged in an array, at least one high-frequency array element is embedded into one low-frequency array elements, and the one low-frequency array element and each high-frequency array element embedded into the one low-frequency array element have a common waveguide wall; and a feeding tributary, wherein radio frequency switches respectively corresponding to the plurality of high-frequency array elements are disposed on the feeding tributary, and each radio frequency switch is configured to control switching of a respective high-frequency array element.

14. The dual-band microwave antenna according to claim 13, wherein the dual-band microwave antenna is a Cassegrain antenna, and a phase center of a feed formed by four array elements in a central area of the high-frequency feed coincides with a focus of the Cassegrain antenna.

15. A dual-band antenna device, comprising:

an indoor microwave unit;

an outdoor microwave unit that is in signal connection with the indoor microwave unit; and a dual-band microwave antenna, wherein the dual-band microwave antenna comprises:

a feed apparatus, wherein the feed apparatus comprises a low-frequency feed and a high-frequency feed embedded into the low-frequency feed, the low-frequency feed comprises a plurality of low-frequency array elements arranged in an array, the high-frequency feed comprises a plurality of high-frequency array elements arranged in an array, at least one high-frequency array element is embedded into one low-frequency array elements, and the one low-frequency array element and each high-frequency array element embedded into the one low-frequency array element have a common waveguide wall; and a feeding tributary, wherein radio frequency switches respectively corresponding to the plurality of high-frequency array elements are disposed on the feeding tributary, and each radio frequency switch is configured to control switching of a respective high-frequency array element;

wherein the dual-band microwave antenna is connected to the outdoor microwave unit by using a feeding waveguide.

* * * * *